US006162977A

United States Patent [19]

Cohen

[11] Patent Number: 6,162,977

[45] Date of Patent: Dec. 19, 2000

[54] BONGO DRUMS

[76] Inventor: Wayne Cohen, 44 Convent Road Silom, Bangrak, Bangkok, Thailand, 10500

[21] Appl. No.: 09/392,954

[22] Filed: Sep. 9, 1999

[51] Int. Cl.[7] ..... G10D 13/02

[52] U.S. Cl. ..... 84/411 R; 84/419; 84/420; 84/421

[58] Field of Search ..... 84/411 R, 419, 84/420, 421

[56] References Cited

U.S. PATENT DOCUMENTS

| | | | |
|---|---|---|---|
| D. 163,538 | 6/1951 | Orta | D17/22 |
| 4,187,635 | 2/1980 | Deissler | 446/416 |
| 4,452,121 | 6/1984 | Green | 84/42 |
| 5,739,448 | 4/1998 | Toscano | 84/413 |
| 5,797,569 | 8/1998 | Simons | 248/187.1 |

FOREIGN PATENT DOCUMENTS 610151 10/1948 United Kingdom .

*Primary Examiner*—Robert E. Nappi
*Assistant Examiner*—Shih-yung Hsieh
*Attorney, Agent, or Firm*—Baker Botts LLP

[57] ABSTRACT

A drum set is formed from two drum shells, each having an extension member. One extension has a recess which receives the other extension to maintain the drum shells in spaced and fixed angular orientation. Ceramic, plastic and wood arrangements are described.

13 Claims, 4 Drawing Sheets

BONGO DRUMS

BACKGROUND OF INVENTION

This invention relates to novelty products and in particular to novelty bongo drums, which can be used as souvenirs of Latin American resorts. Such novelty bongo drums are significantly smaller than conventional bongo drums, having an overall size of about 50 mm. to about 250 mm. Because of the size of such novelty drums, and the fact that manufacturing cost must be minimized, novel, low-cost fabrication arrangements are desirable. The present invention can also be applied as a lower cost manufacturing technique for professional bongo drums.

Conventional bongo drums have wooden or fiberglass drum shells, each about 200 mm in diameter, giving an overall size of over 400 mm. A connecting member, usually of wood joins the two shells of a drum set. The shells are usually fastened together by one or more bolts passing through the connecting member. This construction technique is not easily applied to low-cost novelty bongos and provides assembly problems for smaller drum sets.

It is an object of the present invention to provide a drum assembly that is easy to manufacture at low cost.

SUMMARY OF THE INVENTION

In accordance with the invention there is provided a drum assembly which includes first and second drum shells. The first drum shell has a first extension member having with a recess. The second drum shell has a second extension member which is arranged to be received closely within the recess. The first and second extension members are arranged to fix the relative location between the first and second drum shells. The first and second extension members are adhesively joined together.

In one arrangement the first extension member is a non-circular tube extending outwardly from a side of the first drum shell and the second extension member is an extending dowel shaped to be received in the tube. In one arrangement the non-circular tube has a trapezoidal cross section, and the drum shells are ceramic.

In another arrangement the recess comprises a dovetail groove on the first extension member and a mating dovetail ridge on the second extension member, and the drum shells are plastic or wood.

For a better understanding of the present invention, together with other and further objects, reference is made to the following description, taken in connection with the accompanying drawings, and its scope will be pointed out in the appended claims.

DESCRIPTION OF THE PREFERRED EMBODIMENTS

Figure 1:
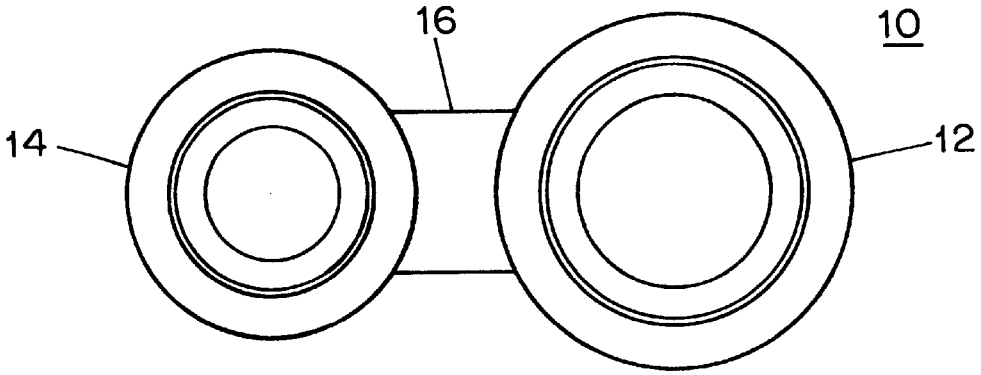
FIG. 1 is a top view of a first embodiment of the present invention.
Figure 2:
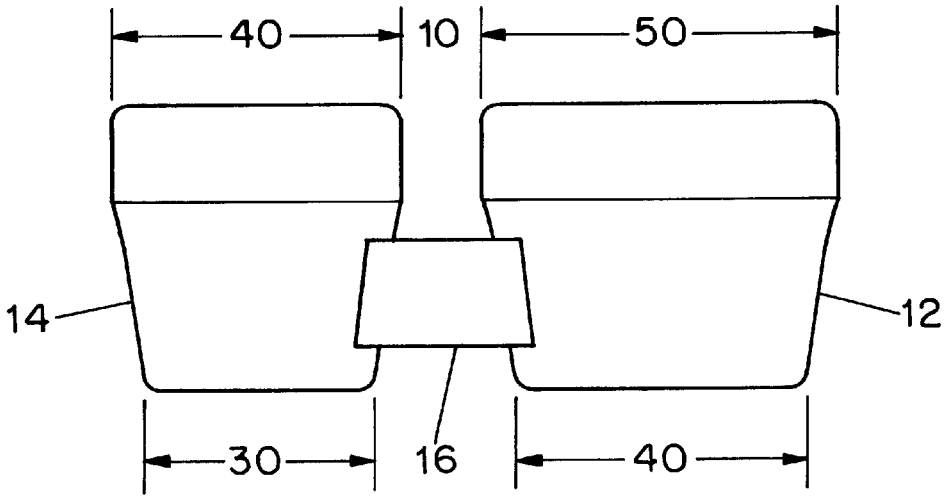
FIG. 2 is a front elevation view thereof.
Figure 3:
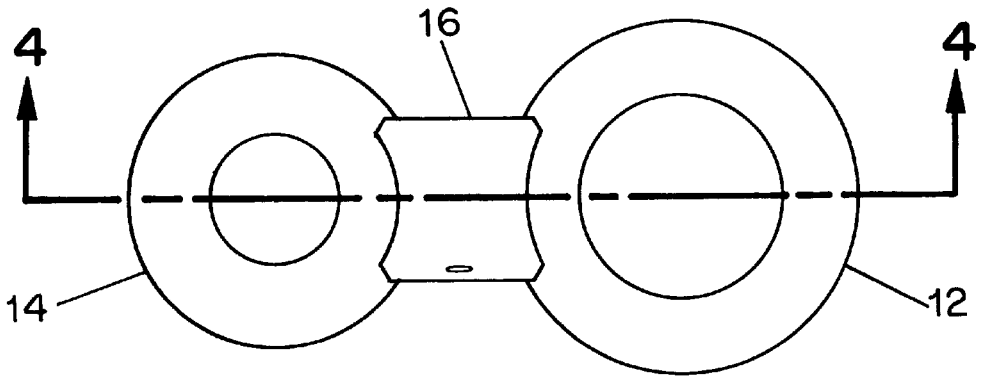
FIG. 3 is a bottom view thereof.

Referring to FIGS. 1 through 8 there is shown a first embodiment of the invention which is fabricated of ceramic. The novelty bongo drum set 10 include drum shells 12 and 14, each of which has a height of 40 mm. First shell 12 has a maximum diameter of 50 mm and is tapered to a diameter of 40 mm. Second shell 14 has a maximum diameter of 40 mm. and is tapered to a diameter of 30 mm. The shells 12, 14, as assembled in set 10, are spaced by about 10 mm using spacer 16. Accordingly, the overall size of assembly 10 is about 100 mm in a maximum dimension which is a convenient size for a souvenir. It should be recognized that the bongo drum assembly can be fabricated to have an overall size of about 50 to 250 mm., and may even be made in a full size, e.g. over 400 mm. size, still retaining the fabrication advantages of the invention.

Referring again to the drawings, it can be seen that the first drum shell 18 and second drum shell 20 are made of ceramic material having a thickness of about 6 mm. in the illustrative embodiment. Other wall thickness may be used, particularly for different size drum sets.

Each drum shell has an upper, generally-cylindrical portion and a lower conical portion. An optional intermediate conical portion separates the upper and lower parts in the illustrated embodiment giving the overall shape of a bongo drum. A membrane (not illustrated) may be stretched across the upper opening and affixed thereto by adhesive. The membrane may be leather, Mylar, latex or other flexible and resilient sheet material to give the novelty assembly a bongo drum-like sound when tapped with the fingers. The exterior surfaces may be ornamented or given a bright coating, which may be glazed by firing the ceramic drum parts.

Figure 4:
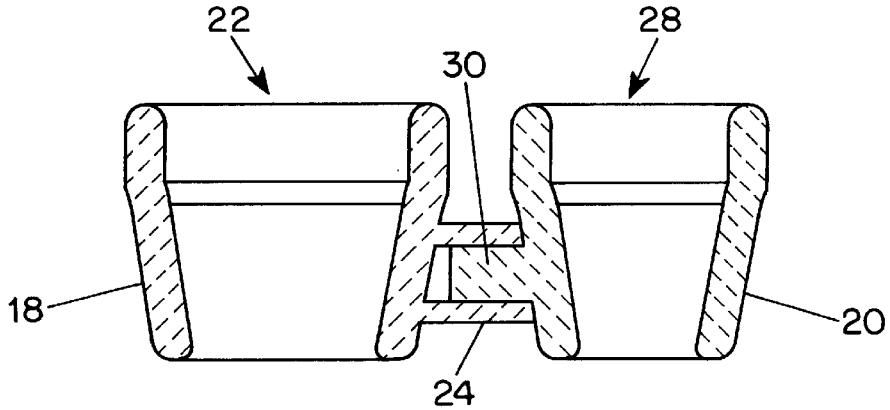
FIG. 4 is a cross-sectional view thereof
Figure 5:
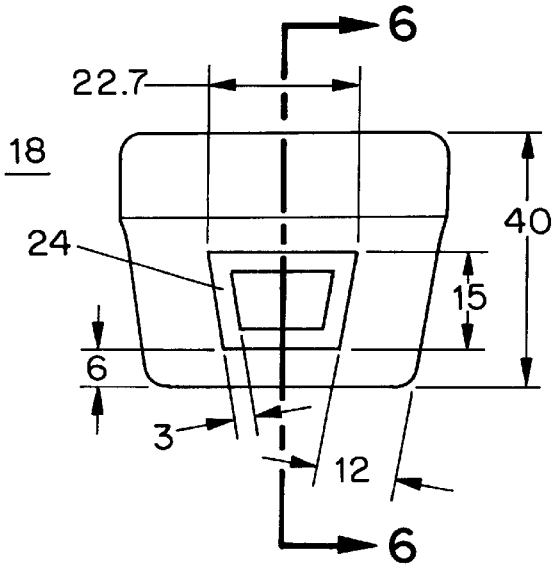
FIG. 5 is a side elevation view of a first part thereof.
Figure 6:
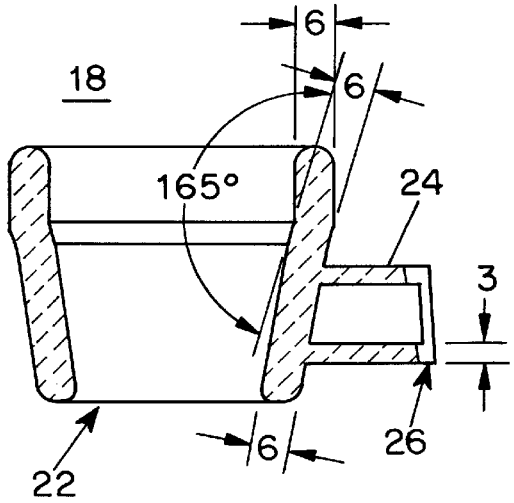
FIG. 6 is a cross-sectional view of the FIG. 5 part.

In a preferred arrangement shown in FIGS. 4 to 8, first drum shell 18 includes a non-circular tube 24 which forms an extension having a recess, which is the tube interior. The extension 24 and drum shell 22 may be separately fabricated of ceramic clay and joined together prior to firing the drum part 18, such that extension 24 and shell 22 are joined in the firing process. Alternately, extension 24 can be molded as part of shell 22, it being understood that the method of fabrication is not germane to the invention. The end 26 of extension 24 is conical to fit flush against the surface of second shell 28, as shown in FIG. 4.

Figure 7:
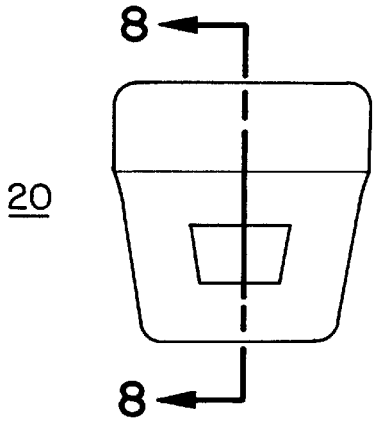
FIG. 7 is a side elevation view if a second part of the FIG. 1 embodiment.
Figure 8:
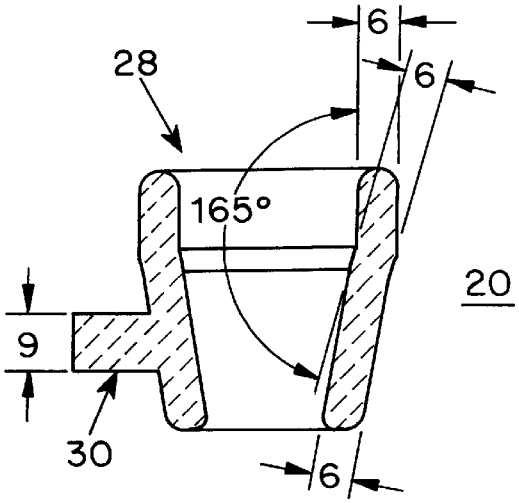
FIG. 8 is a cross-sectional view of the FIG. 7 part.

In the embodiment illustrated, tube 24 has a trapezoidal cross section, and is sized to received dowel extension 30 of second shell part 20, which also has a trapezoidal cross-section as shown in FIG. 7. Dowel extension 30 may be joined to shell 28 in the same manner as described with respect to tube 24. The tube extension 24 and dowel extension 30 may assume a wide variety of cross-sectional shapes, including square, rectangular, oval, etc. Non-circular shapes are preferred to fix the angular orientation of the shells.

The first and second shells 22, 28 are preferably molded and joined to extension members 24, 30. The exterior may be decorated and the parts fired to provide a gloss finish. Alternately the parts may be painted or have decals applied after firing. Alternately the parts may be cured without firing. The parts are joined together by inserting dowel 30 into the interior recess of tube 24 and securing the parts with an appropriate adhesive. The extensions, as so joined, firmly hold the shells 22, 28 in properly spaced relation. Further, the non-circular nature of the recess in extension 24 and dowel extension 30 prevent angular rotation of parts 18 and 20 with respect to each other.

Those skilled in the art will recognize that the parts described can also be fabricated of plastic, such as injection molded plastic.

Figure 9:
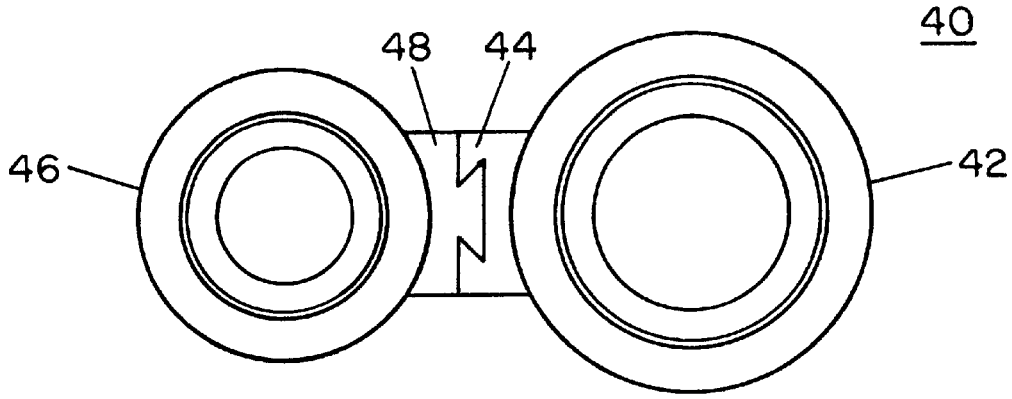
FIG. 9 is a top view of a second embodiment of the invention.
Figure 10:
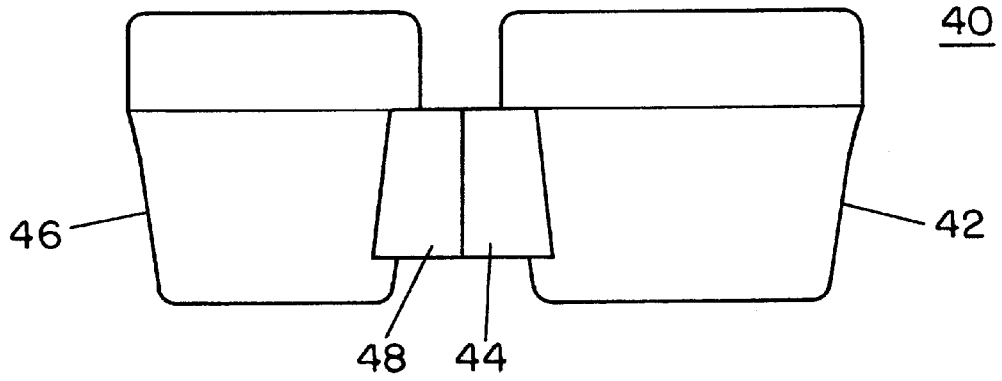
FIG. 10 is a front elevation view of the FIG. 9 embodiment.
Figure 11:
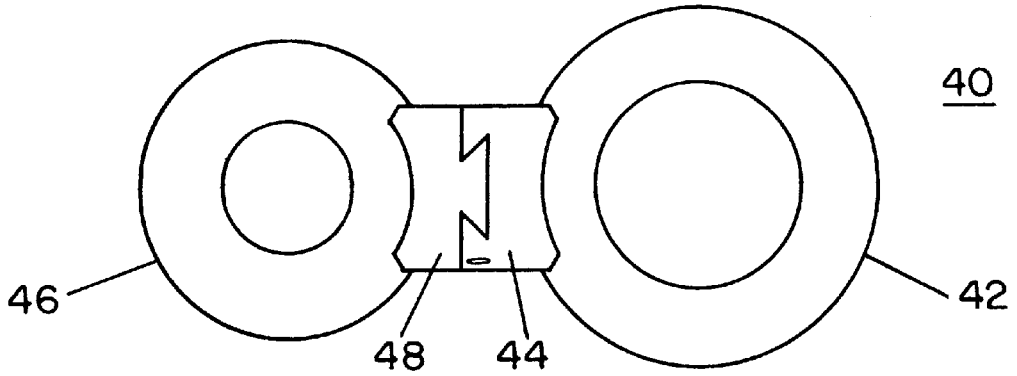
FIG. 11 is a bottom view of the FIG. 9 embodiment.

An alternate embodiment, which is also suitable for plastic or wood fabrication is shown in FIGS. 9 though 11. Drum assembly 40 includes first shell 42 with extension 44 and second shell 46 with extension 48. The extension members 44, 48 may extend to a higher position on shells 42, 46, as shown, to provide easier fabrication out of plastic in a two-part mold. Extension member 44 includes a recess formed as a dovetail groove. Extension 48 includes a mating dovetail ridge which is received in dovetail recess 44 to join the parts, which are fixed with an appropriate adhesive. Other, preferably undercut shapes for the groove and ridge are possible, and the groove and ridge may be horizontal instead of vertical.

Those skilled in the art will recognize that a plastic embodiment may include smaller wall thicknesses and may include further recesses, as appropriate, for molding.

Figure 12:
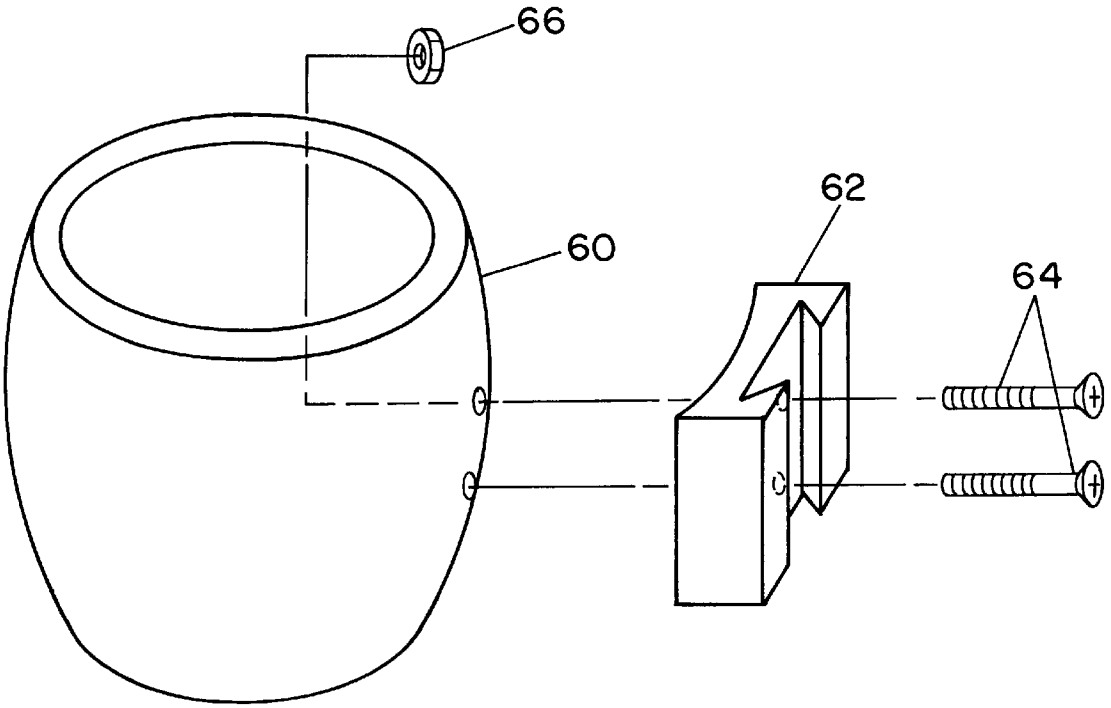
FIG. 12 is an exploded view of a wooded part in accordance with the invention.

FIG. 12 is an exploded view of a part having a bongo drum shell 60 and fabricated out of wood. Part 60 can be turned and bored to form a bongo shell. Extension part 62 may be molded of plastic, or alternatively may be wood which is appropriately turned to mate with exterior of shell 60 and milled or routed to form a dovetail groove. Extension part 62 is fastened to shell 60 using adhesive or using flat-head, countersunk machine screws 64 and nuts 66, such as Timmerman nuts, as illustrated. The mating drum can be similarly formed from wooden parts and/or plastic parts with a mating dovetail ridge.

While there have been described what are believed to be the preferred embodiments of the present invention, those skilled in the art will recognize that other and further modifications may be made thereto without departing from the spirit of the invention, and its is intended to claim all such changes and modifications as fall within the scope of the invention.

I claim:

1. A bongo drum assembly comprising first and second drum shells, said first drum shell having a first extension member comprising a non-circular tube extending outwardly from a side of said first drum shell, said tube having a recess, and said second drum shell having a second extension member, comprising a dowel extending outwardly from a side of said second drum shell and shaped to be received closely within said recess of said tube, said first and second extension members being arranged to fix the relative location between the first and second drum shells, said first and second extension members being adhesively joined together.

2. A drum assembly as specified in claim 1 wherein said non-circular tube has a trapezoidal cross section.

3. A drum assembly as specified in claim 1 wherein said first and second drum shells are molded from ceramic.

4. A drum assembly comprising first and second drum shells, said first drum shell having a first extension member with a recess comprising a dovetail groove and said second drum shell having a second extension member, comprising a mating dovetail ridge, said first and second extension members being arranged to fix the relative location between the first and second drum shells, said first and second extension members being adhesively joined together.

5. A drum as specified in claim 4 wherein said first and second shells are plastic.

6. A drum as specified in claim 4 wherein said first and second shells are wood, and wherein said extension members are affixed to said shells.

7. A bongo drum assembly comprising first and second ceramic drum parts, said first drum part comprising a first drum shell and a first extension member extending from a side of said first drum shell, said first extension member comprising a non-circular ceramic tube, said second drum part comprising a drum shell and a second extension member extending from a side of said second drum shell, said second extension member comprising a dowel shaped to be received in said tube.

8. A drum assembly comprising first and second drum parts, said first drum part comprising a drum shell and a first extension member extending from a side of said first drum shell and including an undercut groove, said second drum part comprising a drum shell and a second extension member extending from a side of said second drum shell including an extending ridge arranged to mate with said undercut groove.

9. A drum assembly as specified in claim 8 wherein said first and second drum parts are plastic.

10. A drum as specified in claim 8 wherein said undercut groove is a dovetail groove.

11. A drum assembly as specified in claim 8 wherein said first and second parts are each formed of a wooden drum shell and a wooden extension affixed thereto.

12. A drum assembly comprising first and second molded drum shells, said first drum shell having an molded first extension member with a recess in said first extension member extending outwardly from a side of said first drum shell and said second drum shell having an molded second extension member extending outwardly from a side of said second drum shell arranged to be received closely within said recess, said first and second extension members being arranged to fix the relative location between the first and second drum shells, said first and second extension members being adhesively joined together.

13. A drum assembly as specified in claim 12, wherein said drum shells are ceramic.

* * * * *